US006718920B2

(12) United States Patent
Hoshino et al.

(10) Patent No.: US 6,718,920 B2
(45) Date of Patent: Apr. 13, 2004

(54) CAMSHAFT ROTATIONAL PHASE DETECTING APPARATUS AND CYLINDER INTAKE AIR QUANTITY CALCULATING APPARATUS FOR ENGINE

(75) Inventors: Masato Hoshino, Kawasaki (JP); Yoshiaki Yoshioka, Kanagawa (JP); Tetsuya Iwasaki, Tokyo (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/062,566

(22) Filed: Feb. 5, 2002

(65) Prior Publication Data

US 2002/0108593 A1 Aug. 15, 2002

(30) Foreign Application Priority Data

Feb. 5, 2001 (JP) ..... 2001-028824

(51) Int. Cl.[7] ..... F01L 1/34

(52) U.S. Cl. ..... 123/90.15; 123/90.17; 123/90.27

(58) Field of Search ..... 123/90.15, 90.16, 123/90.17, 90.27, 90.31

(56) References Cited

U.S. PATENT DOCUMENTS

| | | | | |
|---|---|---|---|---|
| 4,911,133 A | | 3/1990 | Sogawa | |
| 5,363,817 A | * | 11/1994 | Ikeda et al. | 123/90.15 |
| 5,537,961 A | * | 7/1996 | Shigeru et al. | 123/90.15 |
| 5,562,071 A | * | 10/1996 | Urushihata et al. | 123/90.15 |
| 5,609,126 A | * | 3/1997 | Cullen et al. | 123/90.15 |
| 5,715,779 A | * | 2/1998 | Kato et al. | 123/90.15 |
| 5,881,696 A | * | 3/1999 | Wada | 123/406.62 |
| 5,915,362 A | * | 6/1999 | Fuwa et al. | 123/491 |
| 6,006,707 A | | 12/1999 | Ito | |
| 6,257,184 B1 | * | 7/2001 | Yamagishi et al. | 123/90.15 |
| 6,301,543 B2 | * | 10/2001 | Fujiwara et al. | 701/114 |
| 6,311,667 B1 | * | 11/2001 | Satou et al. | 123/295 |
| 6,328,007 B1 | | 12/2001 | Hirasawa et al. | |
| 6,463,912 B1 | * | 10/2002 | Fuwa | 123/480 |

FOREIGN PATENT DOCUMENTS

| | | |
|---|---|---|
| EP | 1 074 716 | 2/2001 |
| JP | 2001-50091 | 2/2001 |

OTHER PUBLICATIONS

U.S. patent application Ser. No. 10/058,294, Iwasaki et al., filed Jan. 30, 2002.

U.S. patent application Ser. No. 10/058,295, Iwasaki et al., filed Jan. 30, 2002.

* cited by examiner

*Primary Examiner*—Thomas Denion
*Assistant Examiner*—Ching Chang
(74) *Attorney, Agent, or Firm*—Foley & Lardner

(57) ABSTRACT

A camshaft rotational phase detecting apparatus for an engine provided with a variable valve timing control mechanism which controls a camshaft rotational phase of an engine valve to a target camshaft rotational phase by varying a rotational phase of a camshaft relative to a crankshaft. The camshaft rotational phase detecting apparatus is configured to detect a camshaft rotational phase as a detected camshaft rotational phase based on a signal from a sensor. In the apparatus, the detected camshaft rotational phase is substituted with a maintained rotational phase for a predetermined period and is substituted with a target camshaft rotational phase after a lapse of the predetermined period, when the camshaft rotational phase is not detected. In the apparatus, the maintained rotational phase is set corresponding to the detected camshaft rotational phase detected before a timing that the camshaft rotational phase is not detected. Additionally, in the apparatus, the predetermined period is set in accordance with an engine temperature.

18 Claims, 10 Drawing Sheets

CAMSHAFT ROTATIONAL PHASE DETECTING APPARATUS AND CYLINDER INTAKE AIR QUANTITY CALCULATING APPARATUS FOR ENGINE

BACKGROUND OF THE INVENTION

This invention relates to improvements in an apparatus for detecting a rotational or angular phase of a camshaft relative to a crankshaft and an apparatus for calculating an intake air quantity of a cylinder by using a detected value of the camshaft rotational phase, in an engine provided with a variable valve timing control mechanism.

A variable valve timing control mechanism for an engine has been hitherto known and configured such that the opening and closing timings of intake and exhaust valves are controlled by varying the rotational phase of a camshaft relative to a crankshaft under a hydraulic pressure. The engine provided with the valve timing control mechanism of this type is usually equipped with a crank angle sensor and a cam angle sensor. The crank angle sensor is adapted to output a crank angle signal every a predetermined angle (for example, 10° in crank angle) in synchronism with rotation of the crankshaft. The cam angle sensor is adapted to produce a cam angle signal every a predetermined angle (for example, 180° in crank angle) in synchronism with rotation of the cam shaft. In accordance with the crank angle signal and the cam angle signal, the rotational phase (so-called VTC phase) of the camshaft relative to the crank shaft is detected to be used for carrying out a variety of engine controls.

SUMMARY OF THE INVENTION

Drawbacks have been encountered in the above technique for detecting the camshaft rotational phase, as set forth below. That is, there is only a detected value of the VTC phase as information at a prior time until the crank angle signal and the cam angle signal are output. However, the actual VTC phase may change by a considerable amount during a time period from a prior time detection of the VTC phase and the current time. Particularly when the engine is stopped under idling stop or the like, detection of the VTC phase cannot be carried out until the crank angle signal and the cam angle signal are again detected upon re-starting of the engine. As a result, a feedback control for the VTC phase cannot be accomplished at a high accuracy.

Additionally, also in case that the mass of air to be sucked into a cylinder is calculated by using a cylinder volume (volume of air) calculated in accordance with the opening and closing timings of the intake and exhaust valves, a control cannot follow the cylinder volume which varies in accordance with the closing timing of the intake valve. As a result, the mass of air to be sucked into the cylinder cannot be calculated at a high accuracy, and therefore a fuel injection control and an air-fuel ratio control for the engine cannot be accomplished at a high accuracy.

Therefore, it is an object of the present invention is to provide an improved camshaft rotational phase detecting apparatus and a cylinder intake air quantity calculating apparatus which can overcome drawbacks encountered in conventional camshaft rotational phase detecting apparatuses and cylinder intake air quantity calculating apparatuses.

Another object of the present invention is to provide an improved camshaft rotational phase detecting apparatus which can estimate an actual rotational phase of a camshaft relative to a crankshaft even in case that the rotational phase cannot be detected, thereby carrying out a variety of controls for an engine at a high accuracy.

A further object of the present invention is to provide an improved cylinder intake air quantity calculating apparatus by which a quantity of air to be sucked into a cylinder of an engine can be effectively calculated even in a condition where the rotational phase of the camshaft cannot be detected or in case that measuring error become large.

An aspect of the present invention resides in a camshaft rotational phase detecting apparatus for an engine provided with a variable valve timing control mechanism which controls a camshaft rotational phase of an engine valve to a target camshaft rotational phase by varying a rotational phase of a camshaft relative to a crankshaft. The camshaft rotational phase detecting apparatus is configured to detect a camshaft rotational phase as a detected camshaft rotational phase based on a signal from a sensor. In the apparatus, the detected camshaft rotational phase is substituted with a maintained rotational phase for a predetermined period and is substituted with a target camshaft rotational phase after a lapse of the predetermined period, when the camshaft rotational phase is not detected. In the apparatus, the maintained rotational phase is set corresponding to the detected camshaft rotational phase detected before a timing that the camshaft rotational phase is not detected. Additionally, in the apparatus, the predetermined period is set in accordance with an engine temperature.

Another aspect of the present invention resides in a camshaft rotational phase detecting apparatus for an engine provided with a variable valve timing control mechanism which controls a camshaft rotational phase of an engine valve by varying a rotational phase of a camshaft relative to a crankshaft. The camshaft rotational phase detecting apparatus is configured to perform detecting a camshaft rotational phase as a detected camshaft rotational phase based on a signal from a sensor, wherein the detected camshaft rotational phase is substituted with a corrected rotational phase when the camshaft rotational phase is not detected. In the apparatus, the corrected rotational phase is provided by correcting the detected camshaft rotational phase detected before a timing that the camshaft rotational phase is not detected, with an engine temperature and an elapsed time from the timing becoming the condition that the camshaft rotational phase is not detected.

A further aspect of the present invention resides in a camshaft rotational phase detecting apparatus for an engine provided with a variable valve timing control mechanism which controls a camshaft rotational phase of an engine valve by varying a rotational phase of a camshaft relative to a crankshaft. The camshaft rotational phase detecting apparatus is configured to perform detecting a camshaft rotational phase based on output of a sensor, wherein the camshaft rotational phase at this time when an engine speed is below a predetermined level is substituted with the camshaft rotational phase which is detected at last time.

A still further aspect of the present invention resides in a cylinder intake air quantity calculating apparatus for an engine. The apparatus comprises a detecting section that detects a camshaft rotational phase as a detected camshaft rotational phase based on a signal from a sensor. In the apparatus, the detected camshaft rotational phase is substituted with a maintained rotational phase for a predetermined period and is substituted with a target camshaft rotational phase after a lapse of the predetermined period, when the camshaft rotational phase is not detected. In the apparatus, the maintained rotational phase is set corresponding to the detected camshaft rotational phase which is detected before a timing that the camshaft rotational phase is not detected. Additionally, the apparatus further comprises a calculating section that calculates a mass air quantity sucked into a cylinder in accordance with the detected camshaft rotational phase derived from the detecting section.

A still further aspect of the present invention resides in a cylinder intake air quantity calculating apparatus for an engine. The apparatus comprises a detecting section that detects a camshaft rotational phase as a detected camshaft rotational phase based on an output from a sensor, wherein the detected camshaft rotational phase is substituted with a corrected rotational phase when the camshaft rotational phase is not detected. In the apparatus, the corrected rotational phase is provided by correcting the detected camshaft rotational phase detected before a timing that the camshaft rotational phase is not detected, with an engine temperature and an elapsed time from the timing becoming the condition that the camshaft rotational phase is not detected. Additionally, the apparatus further comprises a calculating section that calculates a mass air quantity sucked into a cylinder in accordance with the detected camshaft rotational phase derived from the detecting section.

DETAILED DESCRIPTION OF THE INVENTION

Figure 1:
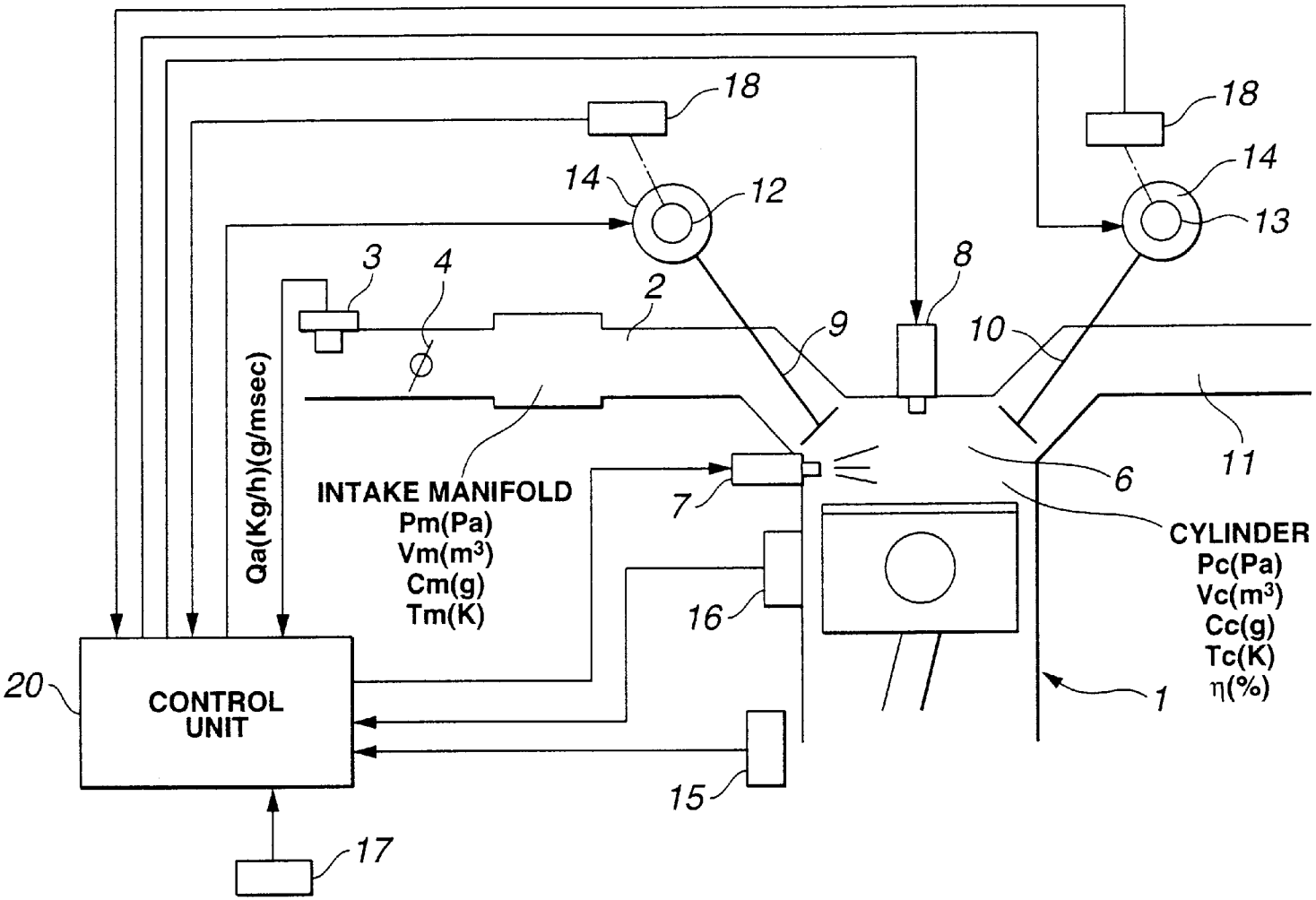
FIG. 1 is a schematic illustration of an internal combustion engine provided with a variable valve control system, incorporated with a control unit functioning as a camshaft rotational phase detecting apparatus and a cylinder intake air quantity calculating apparatus according to the present invention.

Referring now to FIG. 1 of the drawings, automotive internal combustion engine 1 is provided with intake air passageway 2. Airflow meter 3 is disposed in intake air passageway 2 to detect an intake air flow quantity Q which is controlled by throttle valve 4 disposed in intake air passageway 2. Fuel injector valve 7 is disposed in each cylinder of engine 1 to inject fuel into combustion chamber 6. Spark plug 8 is disposed in each cylinder to produce a spark within the combustion chamber 6. Intake air is sucked through intake valve 9 into the combustion chamber, upon which fuel is injected from fuel injector valve 7 to the sucked intake air thereby to form air-fuel mixture. The air-fuel mixture is compressed within combustion chamber 6 and then ignited with the spark produced by spark plug 8. Exhaust gas of the engine is discharged from combustion chamber 6 through an exhaust valve into exhaust gas passageway 11 and released to the atmospheric air through an exhaust gas purifying catalyst (not shown) and a muffler (not shown). Intake valve 9 and exhaust valve 10 are respectively driven by a cam of an intake valve-side camshaft 12 and a cam of an exhaust valve-side camshaft 13, so that the intake valve 9 and the exhaust valve 10 are opened and closed.

A hydraulically operated variable valve timing control mechanism (referred hereafter to as a VTC mechanism) 14 is provided to each of the intake valve-side camshaft 12 and the exhaust valve-side camshaft 13 and adapted to vary a rotational phase of the camshaft relative to a crankshaft (not shown) of the engine thereby advancing and retarding the opening and closing timings of each of the intake and exhaust valves 9, 10.

Control unit (C/U) 20 is configured to control operations of throttle valve 4, fuel injector valve 7 and spark plug 8. Signals from a crank angle sensor 15, a cam angle sensor 18, an engine coolant temperature sensor 16, the airflow meter 3 and the like are input to the control unit 20. Crank angle sensor 15 is adapted to detect an rotational angle of the crankshaft and to output a crank angle signal representative of the crankshaft rotational angle. Cam angle sensor 18 is adapted to detect a rotational angle of the cam of each of intake valve-side camshaft 12 and exhaust valve-side camshaft 13 and to output a cam angle signal representative of the rotational angle of the cam.

The control unit 20 is further configured to detect the rotational phase (referred hereafter to as VTC phase) of intake valve-side camshaft 12 relative to the crankshaft and the rotational phase (VTC phase) of exhaust valve-side camshaft 13 relative to the crankshaft, in accordance with a detected value of the crank angle signal from crank angle sensor 15 and a detected value of a detected value of the cam angle signal from cam angle sensor 18, thereby detecting the opening and closing timings of each of intake and exhaust valve 9, 10. Additionally, the control unit is further configured to decide a target rotational angle or VTC phase (i.e., a valve timing advanced value or a valve timing retarded value) of each of intake valve-side camshaft 12 and exhaust valve-side camshaft 13 in accordance with information or signals representative of engine load, engine speed Ne, the engine coolant temperature Tw and the like. In accordance with the thus decided target rotational angle (advanced value or retarded value in crank angle) of each of intake valve side-camshaft 12 and exhaust valve-side camshaft 13, the opening and closing timings of each of intake and exhaust valves 9, 10 are controlled. Thus, control unit 20 functions as at least a major part of a camshaft rotational phase detecting apparatus and a cylinder intake air quantity calculating apparatus according to the present invention. The camshaft rotational phase detecting apparatus is configured to detect the rotational phase (VTC phase) of the camshaft relative to the crankshaft. The cylinder intake air quantity calculating apparatus is configured to calculate the quantity of intake air to be sucked into the cylinder by using the rotational phase (VTC value) detected by the camshaft rotational phase detecting apparatus.

Figure 2:
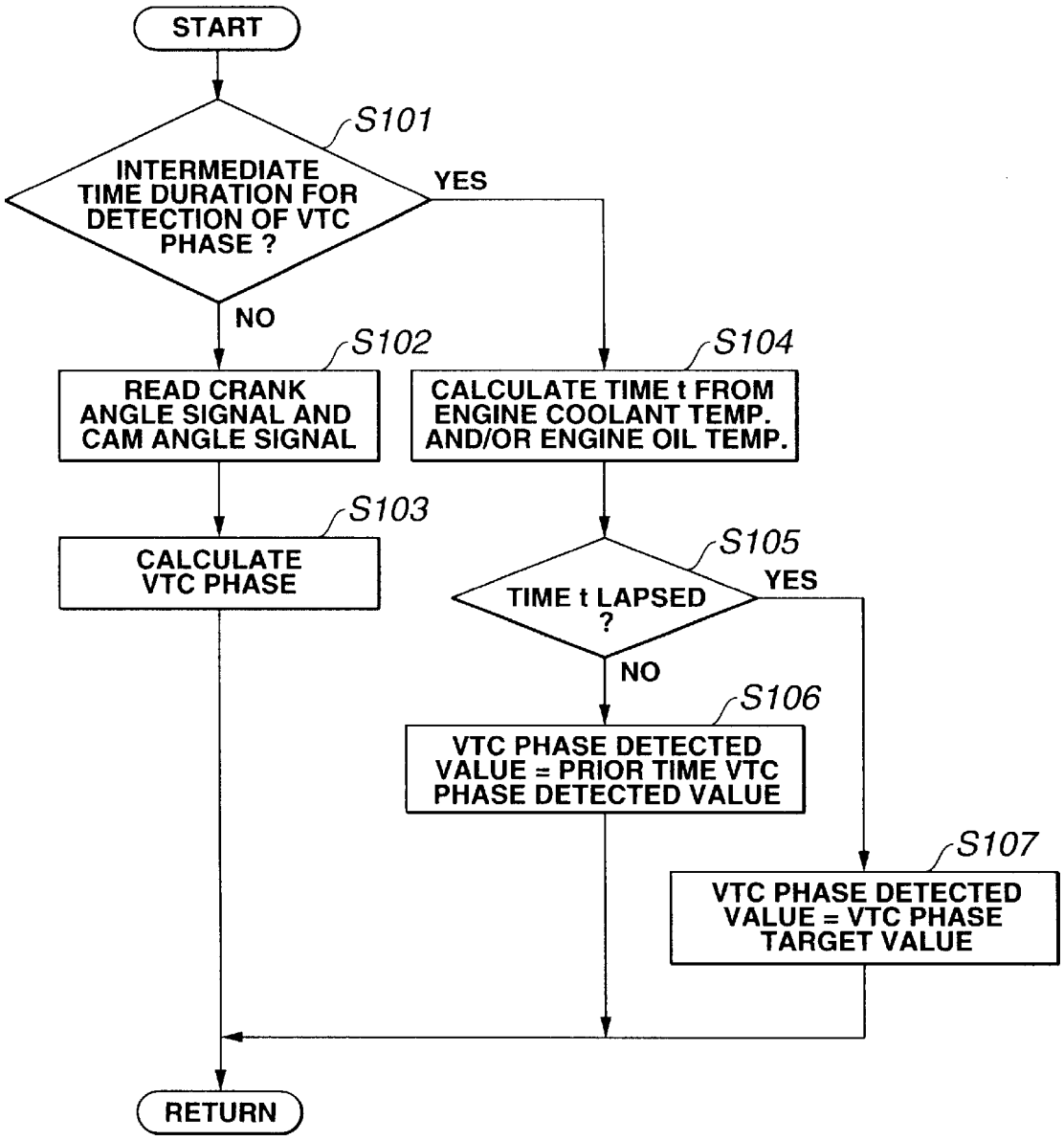
FIG. 2 is a flowchart for setting a rotational phase (VTC phase) of a camshaft relative to a crankshaft, in connection with a first embodiment of a camshaft rotational phase detecting apparatus according to the present invention.

A manner of control of a first embodiment of the camshaft rotational phase detecting apparatus carried out by control unit 20 will be discussed hereinafter with reference to a flowchart in FIG. 2.

At a step S101, a judgment is made as to whether a current time is in a condition in which the rotational phase (VTC phase) of the camshaft cannot be detected (i.e., in an intermediate time duration between a previous detection of the VTC phase of the camshaft and a next detection of the VTC phase of the camshaft), or not. More specifically, the condition in which the rotational phase of the camshaft cannot be detected means the time duration between a previous (prior) time at which the crank angle signal and the cam angle signal are detected and a next (latter) time in which the crank angle and the cam angle signal are again detected. This condition includes a condition in which the engine is stopped, for example, under idling stop.

If the current time is not in the intermediate time duration, new (or current) crank angle signals and new (or current) cam angle signals are output, and therefore a flow goes to a step S102. At the step S102, the crank angle signal and the cam angle signal are read. Then, at a step S103, the VTC phase of each of camshafts 12, 13 calculated in accordance with the crank angle signal and the cam angle signal.

If the current time is in the intermediate time duration, the flow goes to a step S104 at which a predetermined time t (for example, a value around 300 ms) for maintaining the VTC phase which has been detected at a prior time is calculated in accordance with the engine coolant temperature and/or an engine oil temperature of engine 1. This time t is set to be shorter as the engine coolant temperature and/or the engine oil temperature are higher, and to be longer as the engine coolant temperature and/or the engine oil temperature are lower, taking account of the viscosity of a hydraulic (VTC working) fluid or oil for operating VTC mechanism 14.

At a step S105, a judgment is made as to whether the time t calculated at the step S104 has lapsed or not. If the time t has not been lapsed, the flow goes to a step S106 at which the VTC phase (prior time detected value) which has been detected immediately prior to the current time is set as the detected value of the VTC phase. If the time t has lapsed, the flow goes to a step S107 at which the target value of the VTC phase is set as the detected value of the VTC phase.

Figure 3A:
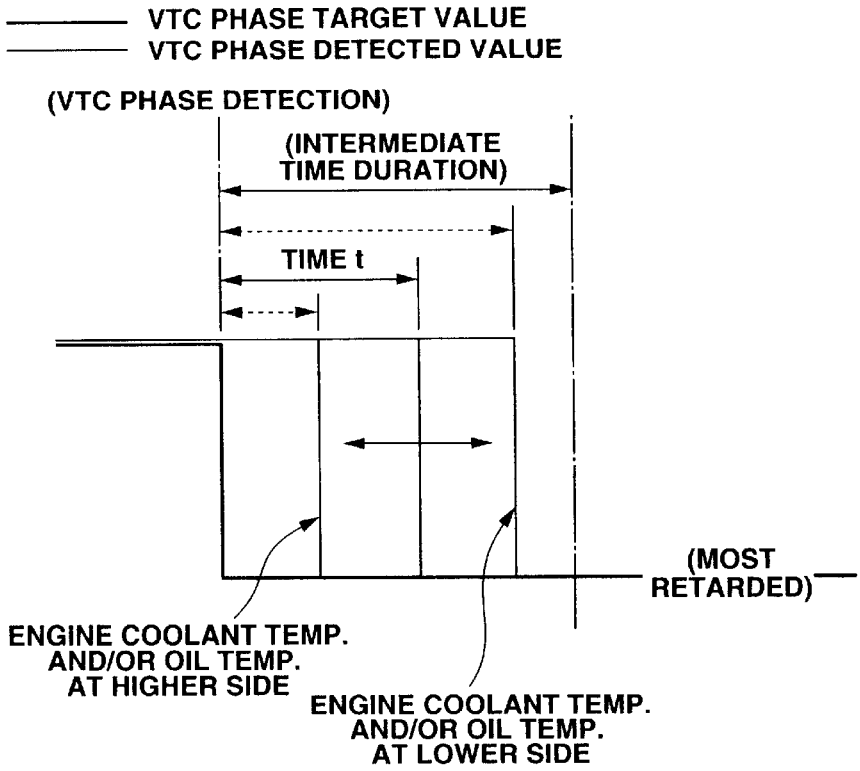
FIG. 3A is an explanative graph for a detected value of the VTC phase in the first embodiment of the camshaft rotational phase detecting apparatus.

With the above control, as shown in FIG. 3A, even in case that the VTC phase cannot be detected, for example, upon the engine being stopped under idling stop, the detected value of the VTC phase (or the prior time detected value) detected immediately prior to the current time is output as the detected value of the VTC phase. Then, after lapse of the time t, the target value of the VTC phase is output as the detected value of the VTC phase. The target value preferably corresponds to the most retarded position or timing (in crank angle) of the intake valve and/or exhaust valve when the engine is stopped.

Figure 3B:
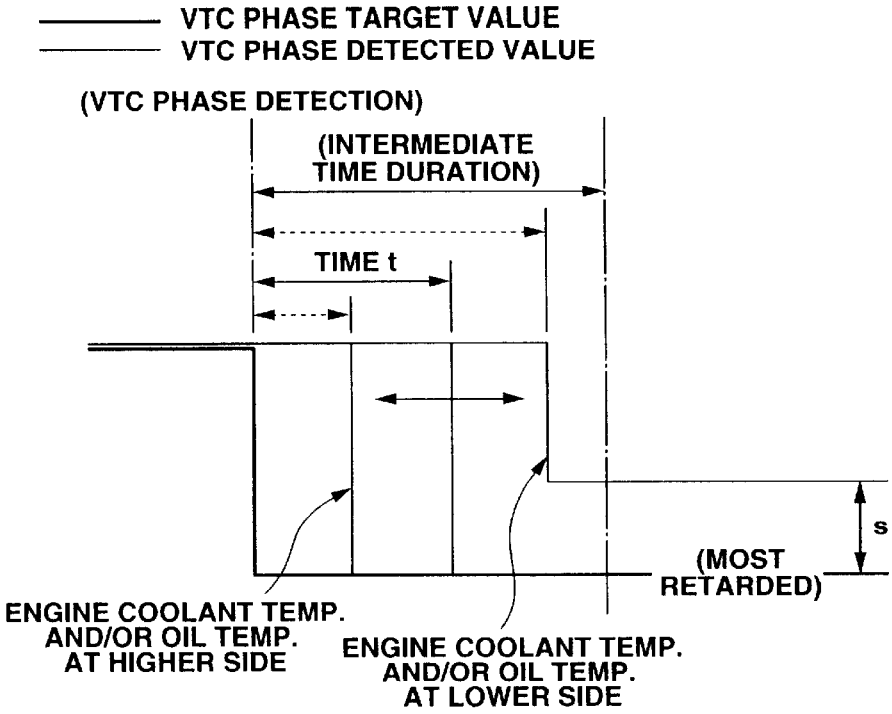
FIG. 3B is an explanative graph similar to FIG. 3A but showing the detected value of the VTC phase in a modified example of the first embodiment of the camshaft rotational phase detecting apparatus, in case that a temperature of the engine is very low.

In case that the engine coolant temperature and the engine oil temperature are very low, the viscosity of the VTC hydraulic fluid becomes high so that replacement of the hydraulic oil in VTC mechanism 14 cannot be effectively accomplished. This may make it impossible that the intake valve and/or the exhaust valve return to their the most retarded position. In such a case, as shown in FIG. 3B, it is preferable to set a value of VTC phase which is advanced by a certain (crank) angle s relative to the most retarded position, as the detected value of the VTC phase.

Thus, according to the above control manner, the detected value of the VTC phase detected immediately prior to the current time or the target value of the VTC phase (VTC phase target value) are set as the detected values of the VTC phase. In other words, the camshaft rotational phase detected immediately prior to the current time is maintained as a detected value for a predetermined time set in accordance with a temperature of the engine, in a condition in which the camshaft rotational phase cannot be detected. Additionally, a target value of the camshaft rotational phase is set as the detected value after lapse of the predetermined time, in the condition in which the camshaft rotational phase cannot be detected. Accordingly, a control is made taking account of the viscosity and the like of the hydraulic fluid for changing the camshaft rotational phase, and therefore the actual camshaft rotational phase can be estimated at a high accuracy, i.e., the detected value of the camshaft rotational phase can be approximated to the actual camshaft rotational phase.

Figure 4:
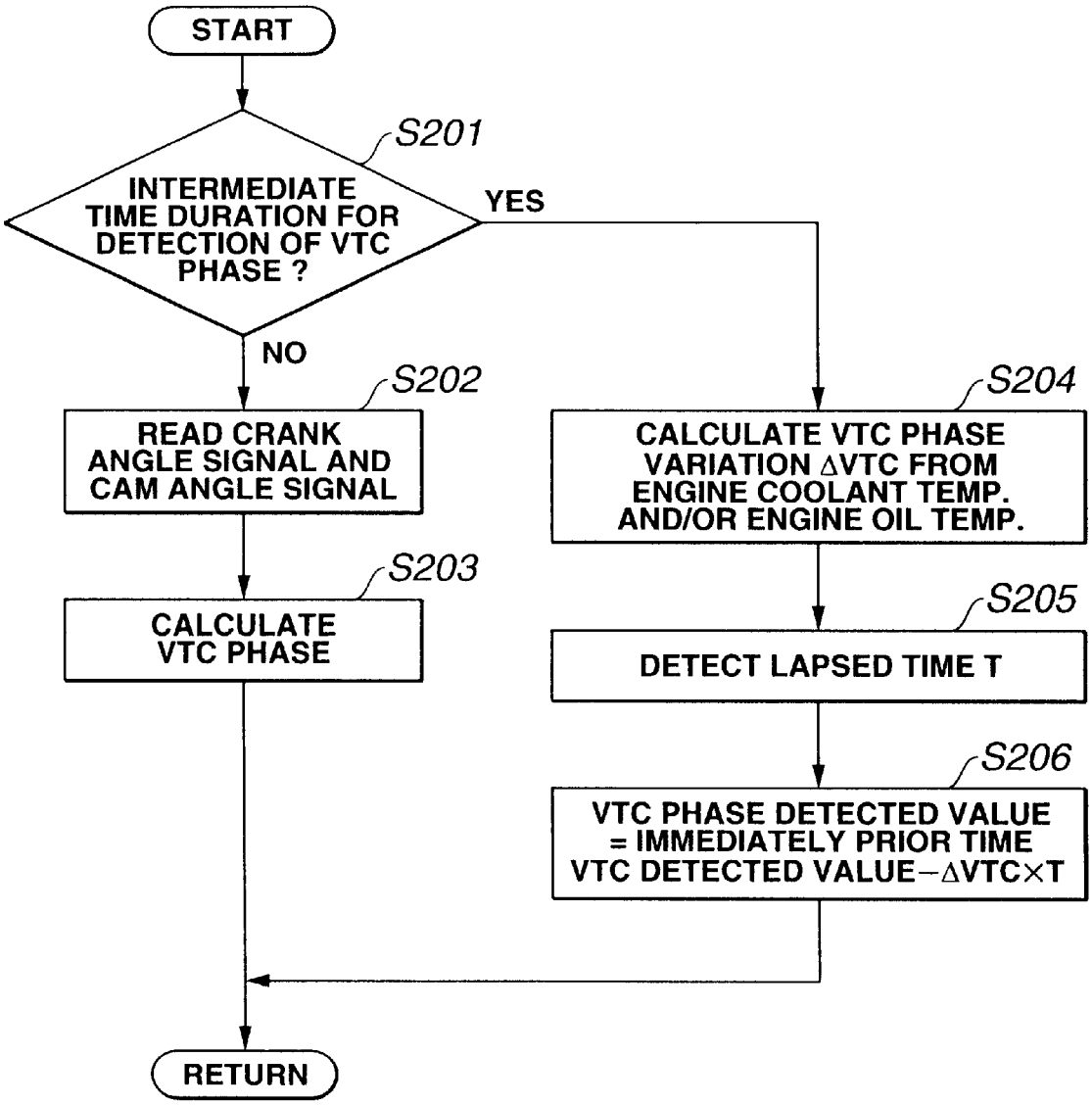
FIG. 4 is a flowchart for setting the VTC phase, in connection with a second embodiment of a camshaft rotational phase detecting apparatus according to the present invention.

Next, a manner of control of a second embodiment of the camshaft rotational phase detecting apparatus carried out by control unit 20 will be discussed hereinafter with reference to a flowchart of FIG. 4 in which steps S201 to S203 are similar to the steps S101 to 103 in FIG. 2. If the current time is in the intermediate time duration at the step S201, the flow goes to a step S204.

At the step S204, a variation (amount) ΔVTC of the VTC phase per unit time is calculated in accordance with the engine coolant temperature and/or an engine oil temperature of engine 1. This VTC variation ΔVTC is set to be larger as the engine coolant temperature and/or the engine oil temperature are higher, and to be smaller as the engine coolant temperature and/or the engine oil temperature are lower, taking account of the viscosity of the hydraulic fluid or oil for operating VTC mechanism 14.

At a step S205, a lapsed time T from the previous detection (at a prior time) of the VTC phase detected value to the current time is detected. This lapsed time T is a time which has lapsed since detection of the VTC phase has become impossible.

At a step S206, the VTC variation (ΔVTC×T) is subtracted from the VTC phase detected value (immediately prior time VTC detected value) which has been detected immediately prior to the current time, thereby producing the VTC value detected value.

Figure 5A:
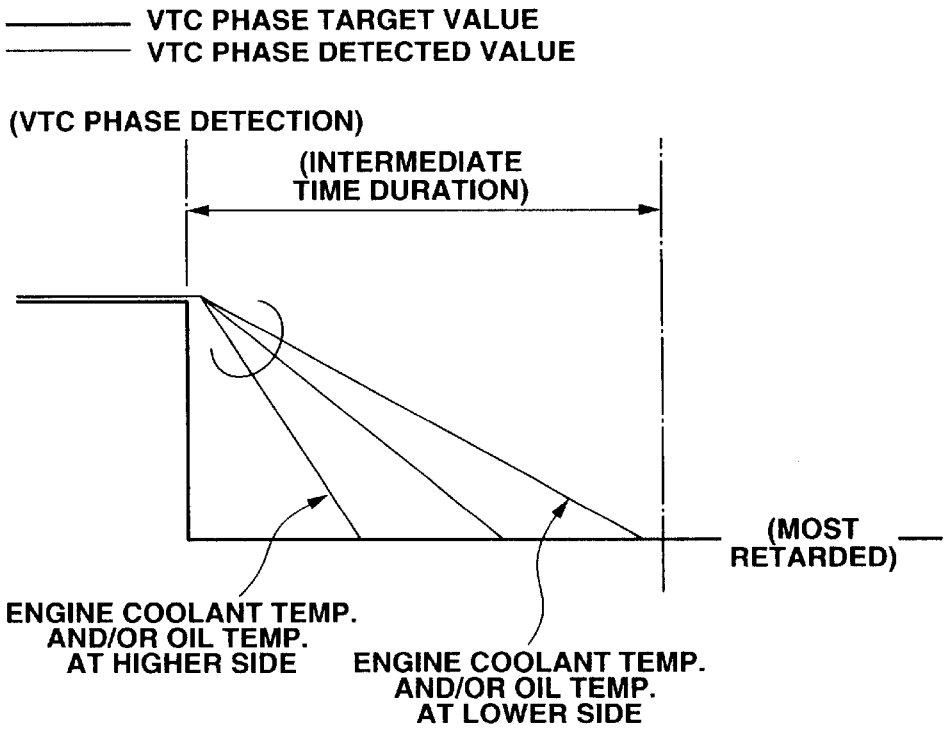
FIG. 5A is an explanative graph for a detected value of the VTC phase in the second embodiment of the camshaft rotational phase detecting apparatus.
Figure 5B:
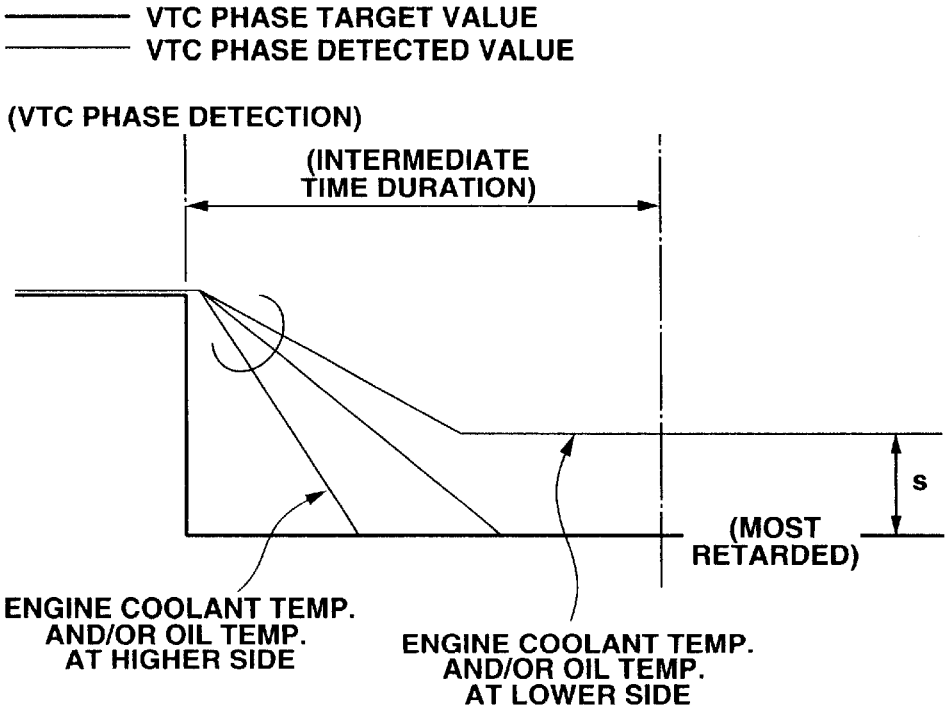
FIG. 5B is an explanative graph similar to FIG. 3A but showing the detected value of the VTC phase in a modified example of the second embodiment of the camshaft rotational phase detecting apparatus, in case that a temperature of the engine is very low.

It will be understood that the control manners of FIGS. 5A and 5B of this embodiment correspond respectively to the control manners of FIGS. 3A and 3B of the first embodiment.

With the control of this embodiments, as shown in FIG. 5A, even in case that the VTC phase cannot be detected, for example, upon the engine being stopped under idling stop, the detected value of the VTC phase (or the prior time detected value) detected immediately prior to the current time is corrected in accordance with the engine coolant temperature and/or the engine oil temperature and the lapsed time T, and then is output as the detected value of the VTC phase. The target value preferably corresponds to the most retarded position or timing (in crank angle) of the intake valve and/or exhaust valve when the engine is stopped.

In case that the engine coolant temperature and the engine oil temperature are very low, the viscosity of the VTC hydraulic fluid becomes high so that replacement of the hydraulic oil in VTC mechanism 14 cannot be effectively accomplished. This may make it impossible that the intake valve and/or the exhaust valve return to their the most retarded position. In such a case, as shown in FIG. 5B, it is preferable to set the VTC phase value which is advanced by the certain (crank) angle s relative to the most retarded position, as the detected value of the VTC phase.

As will be understood, according to the second embodiment, the immediately prior time VTC detected value is corrected in accordance with the engine coolant temperature and/or the engine oil temperature and the lapsed time, thereby producing the VTC phase detected value. In other words, the camshaft rotational phase detected at the prior time immediately prior to the current time is corrected in accordance with the temperature of the engine and a time lapsed from the prior time to the current time, in the condition in which the camshaft rotational phase cannot be detected. Then, the corrected camshaft rotational phase is set as a detected value. As a result, the actual camshaft rotational phase can be estimated in a further high accuracy upon taking account of the viscosity and the like of the hydraulic fluid.

While the camshaft rotational phase control systems of the above embodiments have been shown and described as being applied to the engine provided with the hydraulically operated variable valve timing mechanism, it will be understood that the camshaft rotational phase control systems may be applied to an engine provided with a variable valve timing mechanism of the type wherein the rotational phase of a camshaft relative to a crankshaft is varied under frictional braking of an electromagnetic brake, in which the internal resistance and friction of the electromagnetic brake changes thereby changing a responsiveness.

Thus, according to the above controls of the first and second examples, even in case that the VTC phase cannot be detected under engine stop or the like, the VTC phase can be precisely estimated, thereby carrying out a variety of engine controls.

Figure 6:
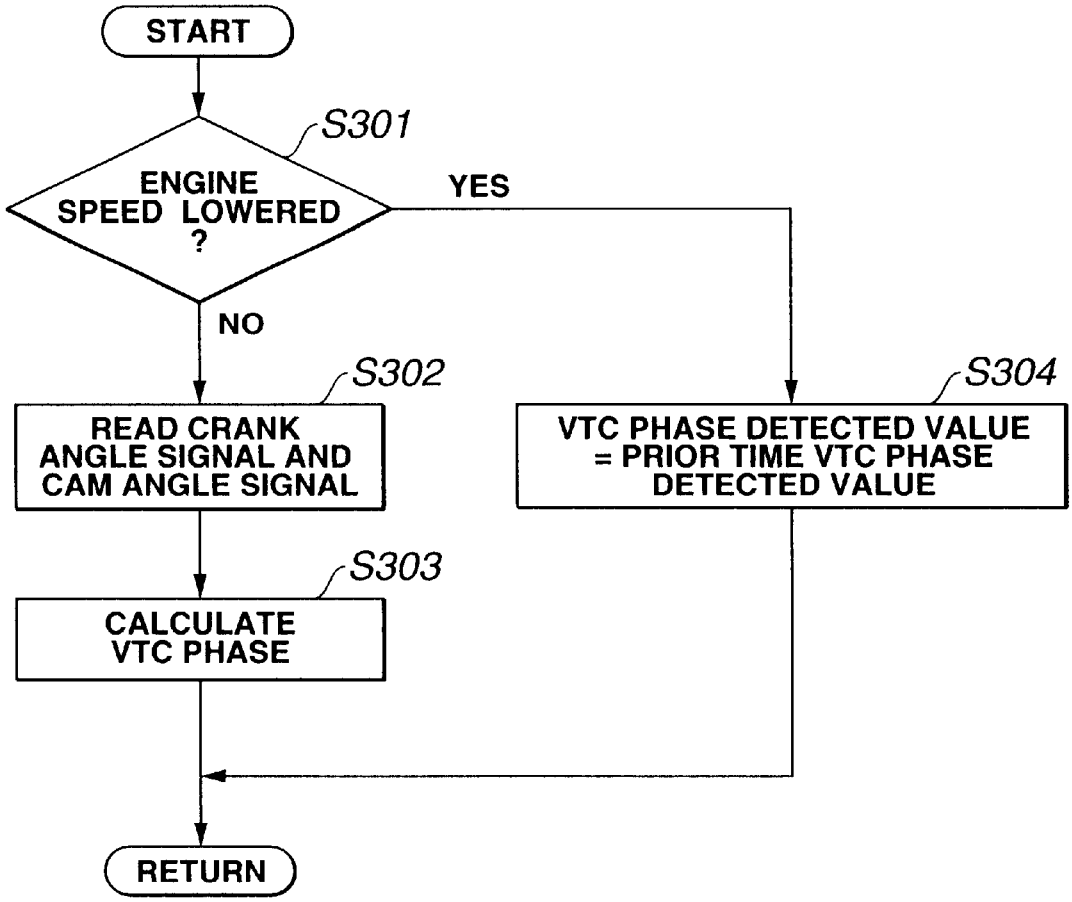
FIG. 6 is a flowchart for setting the VTC phase, in connection with a third embodiment of a camshaft rotational phase detecting apparatus according to the present invention.

Next, a manner of control of a third embodiment of the camshaft rotational phase detecting apparatus according to the present invention will be discussed with reference to FIG. 6 in addition to FIG. 1.

At a step S301, a judgment is made as to whether an engine speed Ne of engine 1 lowers below a predetermined level (engine speed) Ns or not. The predetermined level is, for example, a value around 200 to 300 r.p.m. When the engine speed Ne is not lower than the predetermined level Ns, a flow goes to a step S302 at which the crank angle signal and the cam angle signal are read. At a step S303, the VTC phase is calculated in accordance with the read crank angle and cam angle signals.

When the engine speed Ne is lower than the predetermined level Ns, the flow goes to a step S304 at which the VTC phase detected immediately prior to the current time is used as the detected value of the VTC phase.

That is to say, in such a lower engine speed range of the engine that a hydraulic pressure for operating the VTC mechanism cannot be secured, it is usual that measuring error of the VTC phase becomes large thereby making it impossible to detect the VTC phase at a high accuracy. However, according to the third embodiment, the VTC phase detected at a time (immediately prior to the current time) at which the engine speed is not lower than the predetermined level Ns is used as the VTC phase detected value, thereby making is possible to carry out a variety of engine controls at a high accuracy. Accordingly, stable and accurate controls for the engine can be achieved.

Thus, according to the third embodiment, when the engine speed Ne lowers below the predetermined level Ns, the VTC phase detected immediately prior to the current time and at the engine speed of not lower than the predetermined level Ns is used as the detected value.

Next, discussion will be made on calculation of a cylinder intake air quantity in accordance with the above detected VTC phase, with reference to FIG. 1. The quantity (a fuel injection quantity) of fuel to be injected from fuel injector 11 is controlled basically relative to the cylinder intake air quantity (air mass) Cc thereby to form an air-fuel mixture having a desirable air-fuel ratio. The cylinder intake air quantity Cc is calculated in accordance with an intake air quantity (mass flow rate) measured by airflow meter 3.

Hereinafter, calculation of the cylinder intake air quantity Cc for control of the fuel injection quantity will be discussed with reference to a block diagram of FIG. 7 and flowcharts of FIGS. 8 to 13 which respectively show routines in controls.

As shown in FIG. 1, a unit of the intake air quantity (mass flow rate) measured by means of airflow meter 3 is Qa (Kg/h). However, intake air quantity Qa is multiplied by $1/3600$ to handle it as g/msec.

Then, suppose that a pressure at the intake manifold is Pm (Pa), a volume is Vm ($m^3$; constant), an air mass is Cm (g), and a temperature is Tm (K).

In addition, suppose that the pressure within each cylinder is Pc (Pa), the volume is Vc ($m^3$), the air mass is Cc (g), and the temperature is Tc (K), and a rate of a fresh air within the cylinder is $\eta$ (%).

Furthermore, suppose that Pm=Pc and Tm=Tc (both pressure and temperature are not varied) between the intake manifold and the cylinder.

Figure 8:
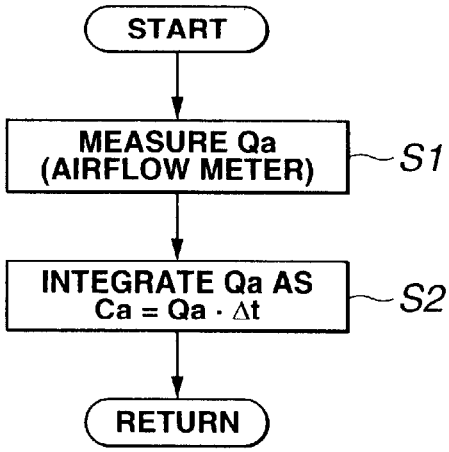
FIG. 8 is an example of an operational flowchart representing a calculation routine of an intake air quantity flowing into an intake manifold shown in FIG. 1.

FIG. 8 shows the flowchart representing a calculation routine of an air quantity Ca flowing into the intake manifold. The routine shown in FIG. 8 is executed for each predetermined time $\Delta t$ (for example, 1 millisecond).

At a step S1 shown in FIG. 8, control unit 20 measures intake air quantity Qa (mass flow rate; g/msec.) from the output of airflow meter 14.

At a step S2, control unit 20 integrates intake air quantity Qa to calculate air quantity Ca (air mass; g) flowing into the manifold portion for each predetermined period of time $\Delta t$ ($Ca=Qa\cdot\Delta t$).

Figure 9:
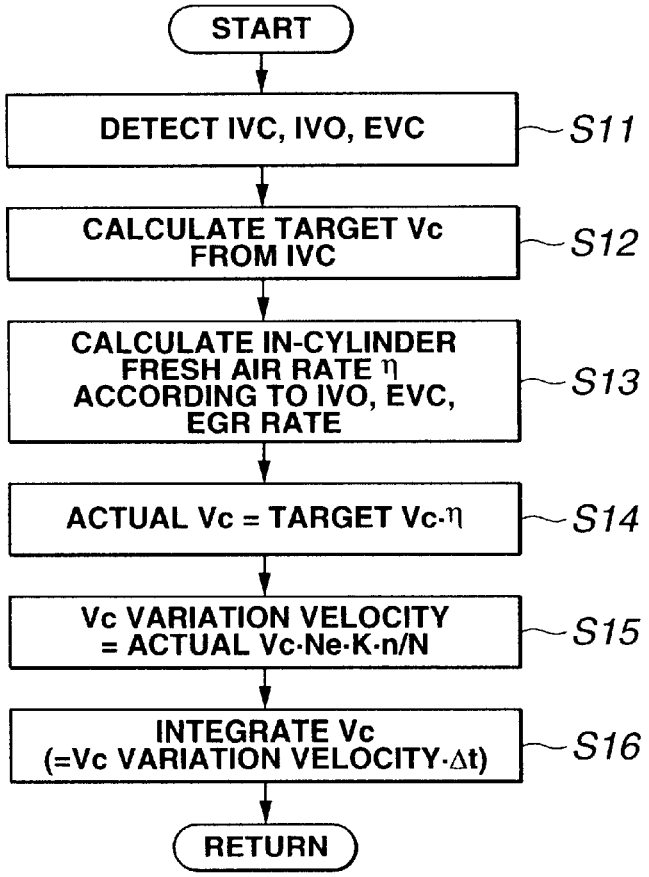
FIG. 9 is an example of an operational flowchart representing a calculation routine of a volume of a cylinder in the engine shown in FIG. 1.

FIG. 9 shows the flowchart representing a calculation routine of the cylinder volume.

The calculation routine shown in FIG. 9 is executed for each predetermined time Δt.

At a step S11, control unit 20 detects closing timing IVC of intake valve 9, opening timing IVO of intake valve 9, and closing timing EVC of exhaust valve 10. These timings are detected in accordance with the VTC phase detected values detected in any of the camshaft rotational phase detecting apparatus of the first, second and third embodiments shown respectively in FIGS. 2, 4 and 6.

At the next step S12, control unit 20 calculates an instantaneous cylinder air volume from the time IVC at which intake valve 9 is closed and sets the calculated cylinder volume as a target volume Vc ($m^3$).

At the next step S13, control unit 20 calculates a (in-cylinder) fresh air rate η (%) within the cylinder according to opening valve timing IVO of intake valve 9 and closing timing EVC of exhaust valve 10, and an EGR (Exhaust Gas Recirculation) rate, if necessary.

That is to say, a valve overlap displacement between intake valve 9 and exhaust valve 10 is defined according to opening timing IVO of intake valve 9 and closing timing IVO of exhaust valve 10. As the overlapped phase becomes larger, a remaining quantity of gas (an internal EGR rate) becomes larger. Hence, the rate η of the fresh air within the cylinder is derived on the basis of the valve overlap displacement.

In addition, in the engine provided with the variable valve timing control mechanism, a control over the valve overlap displacement permits a flexible control over the internal EGR rate. Although, in general, an EGR device (external EGR) is not installed, the EGR device may be installed. In this latter case, a final in-cylinder fresh air rate η is determined upon taking account of the EGR rate of the EGR device.

At the next step S14, control unit 20 calculates an actual Vc ($m^3$) corresponding to the target air quantity (=target Vc·η) by multiplying the fresh air rate η within the cylinder by the target Vc. At a step S15, control unit 20 multiplies the actual Vc ($m^3$) corresponding to the target air quantity by the engine speed Ne (rpm) to derive a variation velocity of Vc (volume flow rate; $m^3$/msec.) as given by the following equation:

$$Vc \text{ variation velocity} = \text{actual } Vc \cdot Ne \cdot K$$

wherein k denotes a constant to align the respective units into one unit and equals to $1/30 \cdot 1/1000$. It is noted that $1/30$ means a conversion from Ne (rpm) to Ne (180 deg./sec.) and $1/1000$ means the conversion of Vc ($m^3$/sec) into $m^3$/sec.

It is also noted that, in a case where such a control as to stop operations of parts of the whole cylinders is performed, the following equation is used in place of the above equation of Vc variation velocity:

$$Vc \text{ variation velocity} = \text{actual } Vc \cdot Ne \cdot K \cdot n/N$$

In this equation, n/N denotes an operating ratio of the whole cylinders when the parts of the whole cylinders are stopped, N denotes the number of the whole cylinders, and n denotes the number of the parts of the whole cylinders which are operated. Hence, if, for example, in a four-cylinder engine, one cylinder is stopped, n/N equals to ¾.

It is noted that, in a case where the operation of a particular cylinder is stopped, the fuel supply to the particular cylinder is cut off with intake valve 9 and exhaust valve 10 of the particular cylinder held under respective complete closing conditions.

At the next step S16, control unit 20 integrates the Vc variation velocity (volume flow rate; $m^3$/msec.) to calculate cylinder air volume Vc ($m^3$)=Vc variation velocity·Δt.

Figure 10:
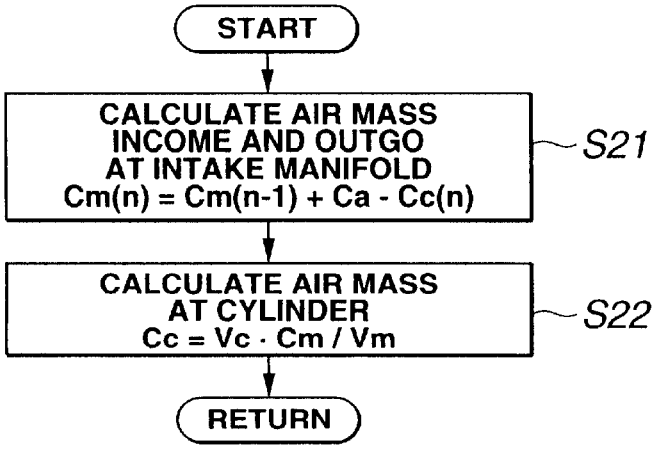
FIG. 10 is an example of an operational flowchart representing a continuous calculation routine of an intake manifold income and outgo calculation and a cylinder intake air quantity.

FIG. 10 shows the flowchart representing a continuous calculation routine.

The calculation routines of an intake air income and outgo at the intake manifold and of the cylinder intake air mass are executed as shown in FIG. 10 for each predetermined period of time Δt.

Figure 11:
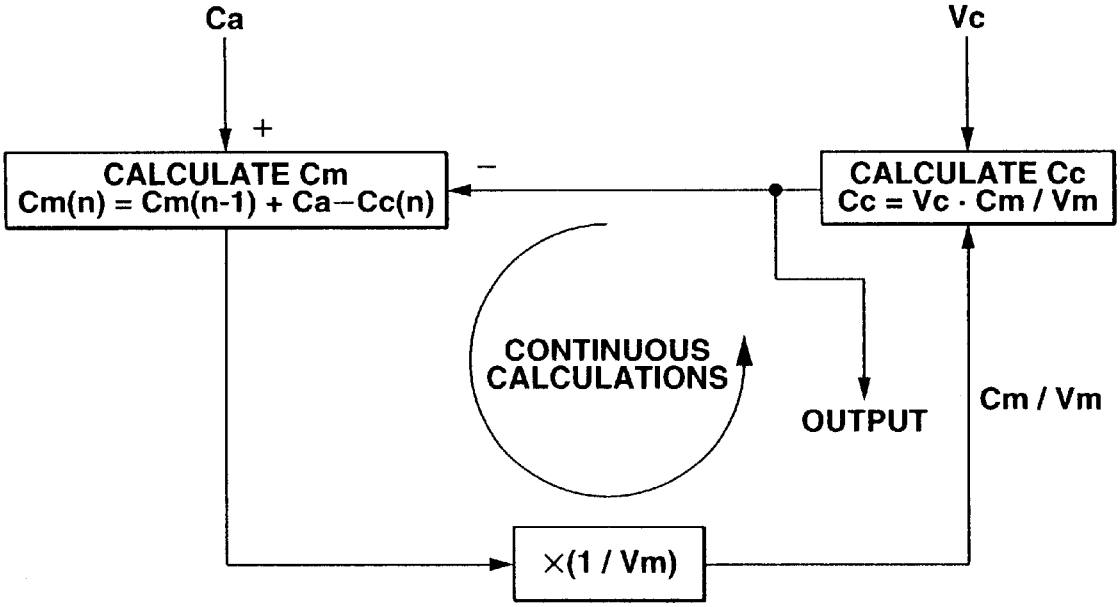
FIG. 11 is a schematic block diagram for explaining the continuous calculation shown in FIG. 10.
Figure 12:
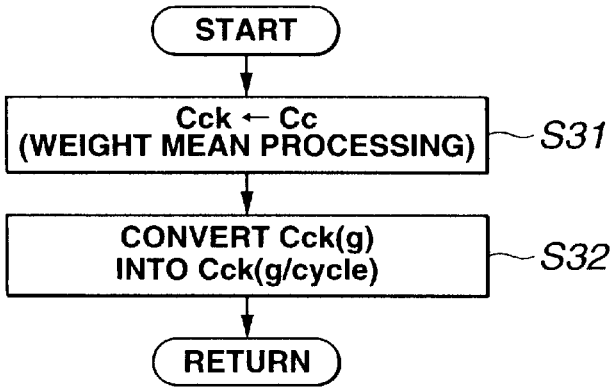
FIG. 12 is an example of an operational flowchart representing a post-process routine.

FIG. 11 shows a block diagram of the continuous calculating block.

At a step S21 in FIG. 10, to calculate the intake income and outgo quantity in the intake manifold (the income and outgo calculation of the air mass Ca (=Qa·Δt) flowing into the manifold portion derived at the routine shown in FIG. 8 is added to a previous value Cm(n−1) of the air mass at the intake manifold. Then, cylinder air mass Cc(n) which is the intake air quantity into the corresponding cylinder is subtracted from the added result described above to calculate the air mass Cm(n) (g) in the intake manifold. That is to say, as shown in FIG. 10, $$Cm(n)=Cm(n-1)+Ca-Cc(n) \quad (1')$$

It is noted that, in this equation, Cc(n) denotes Cc of the air mass at the cylinder calculated at step S32 in the previous routine.

At step S22, to calculate the cylinder intake air quantity (air mass Cc at the cylinder), control unit 20 multiplies cylinder air volume Vc derived at the routine shown in FIG. 9 with air mass Cm at the intake manifold and divides the multiplied result described above by manifold volume Vm (constant) to calculate a cylinder air mass Cc(g) as given by the following equation:

$$Cc=Vc \cdot Cm/Vm \quad (1)$$

Equation (1) can be given as follows: according to an equation of gas state, P·V=C·R·T, and therefore C=P·V/(R·T). Accordingly, concerning the cylinder, $$Cc=Pc \cdot Vc/(R \cdot Tc) \quad (2).$$

Suppose that Pc=Pm and Tc=Tm.

$$Cc=Pm \cdot Vc/(R \cdot Tm) \quad (3).$$

On the other hand, since, according to the gas state equation of P·V=C·R·T, and therefore P/(R·T)=C/V. Accordingly, concerning the intake manifold, $$m/(R \cdot Tm)=Cm/Vm \quad (4).$$

If equation (4) is substituted into equation (3), Cc=Vc·[Pm/(R·Tm)]=Vc·[Cm/Vm] and equation (1) can be obtained.

Figure 7:
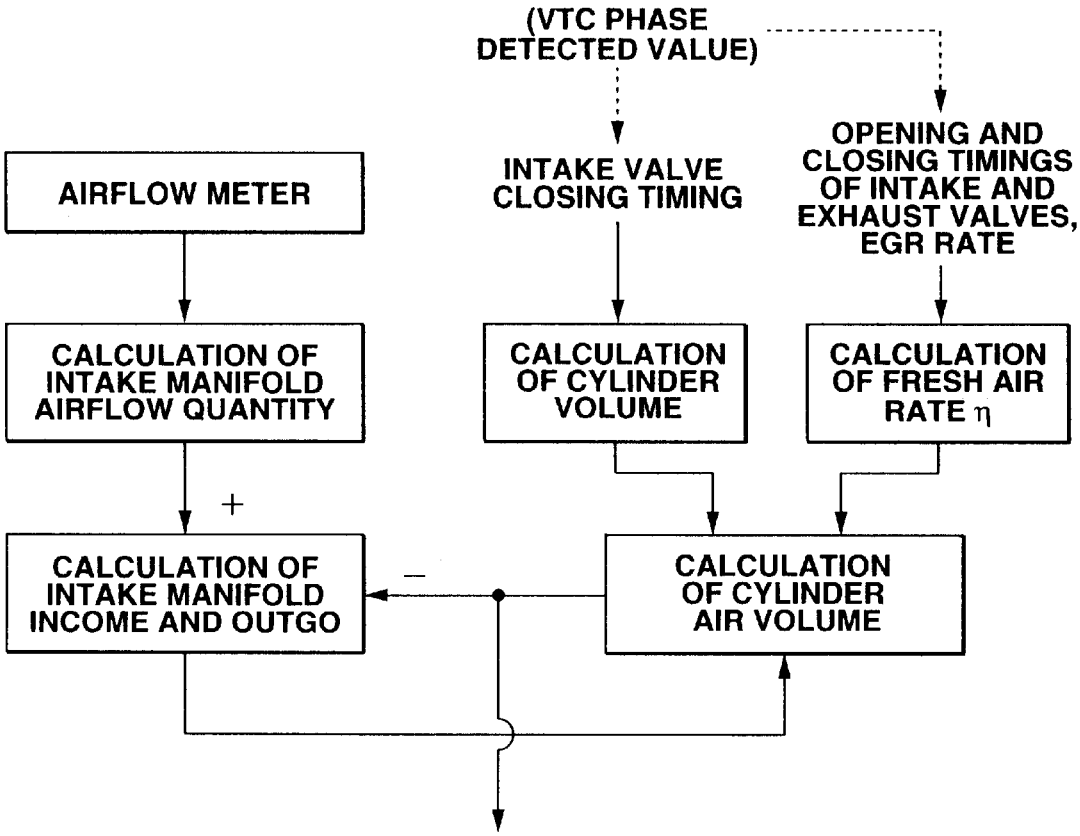
FIG. 7 is a block diagram showing a control of a quantity of air to be sucked into a cylinder of the engine in the intake air quantity calculating apparatus according to the present invention.

As described above, executions of steps S21 and S22 are repeated, namely, the continuous calculation as shown in FIG. 7 which represents the cylinder intake air quantity can be obtained and can be output. It is noted that a processing order of steps S21 and S22 may be reversed.

FIG. 8 shows the flowchart representing a post-process routine.

That is to say, at a step S31, control unit 20 carries out calculation of a weight mean of cylinder air mass Cc (g) to calculate Cck(g) according to the following equation:

$$Cck=Cck \times (1-M)+Cc \times M \quad (4')$$

In equation (4'), M denotes a weight mean constant and 0<M<1.

At a step S32, in order to convert the air mass Cck(g) at the cylinder after the weight mean processing into that corresponding to one cycle of a four-stroke engine, control unit 20 converts air mass Cck(g) into the air mass (g/cycle) at the cylinder for each cycle (two crankshaft revolutions= 720 degrees) according to the following equation and using the engine speed Ne (r.p.m.):

$$Cck(g/\text{cycle})=Cck/(120/Ne)$$

It is noted that if the weight mean processing is carried out only when a large intake pulsation occurs in such as a widely opened throttle valve (completely open), both of a control accuracy and a control response characteristic can be incompatible.

Figure 13:
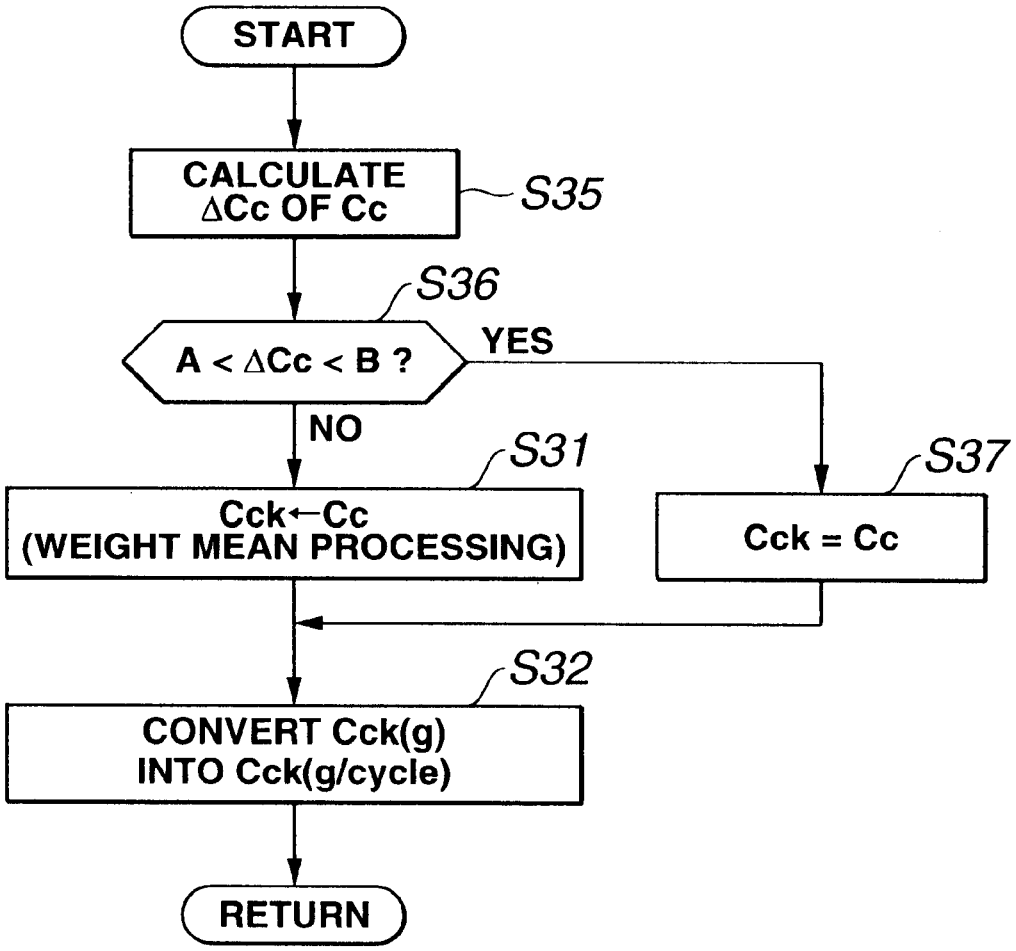
FIG. 13 is another example of an operational flowchart representing the post-process routine.

FIG. 13 shows the flowchart representing the calculation process on the post-process routine in the above described case.

That is to say, at a step S35, control unit 20 calculates a variation rate ΔCc of air mass Cc(g) at the cylinder.

At the next step S36, control unit 20 compares variation ΔCc with both of certain values A and B (A<B) to determine whether variation rate ΔCc falls within a certain range. If A<ΔCc<B (Yes) at step S36, control unit 20 determines that it is not necessary to perform the weight mean processing and the routine goes to a step S37.

At step S37, Cck (g)=Cc(g) is established. Thereafter, the routine goes to a step S32. At the step S32, control unit 20 converts cylinder air mass Cck (g/cycle) for each cycle (two crankshaft revolutions=720 deg.) in the same manner as the step S32 shown in FIG. 12.

According to above control, the cylinder volume (or the volume of whole gas to be sucked into the cylinder) is calculated in accordance with the closing timing of the intake valve. Then, the volume of air to be sucked into the cylinder is calculated in accordance with the whole gas volume and the fresh air rate within the cylinder. Accordingly, on the assumption that the pressure and temperature within the intake manifold and those within the cylinder at the timing of completion of the intake stroke are respectively equal to each other, the density of air within the intake manifold (obtained by dividing the mass of air within the intake manifold by the volume of the intake manifold) is equal to the density of air within the cylinder. This relationship is used to calculate the mass of air to be sucked into the cylinder.

As appreciated from the above, by calculating the cylinder intake air quantity (cylinder air mass Cc, Cck), the cylinder intake air quantity can be calculated at a high accuracy even in case that the VTC phase cannot be detected. By this, a fuel injection quantity control and an air-fuel ratio control for the engine can be carried out at a high accuracy.

The entire contents of Japanese Patent Application P2001-028824 (filed Feb. 5, 2001) are incorporated herein by reference.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

What is claimed is:

1. A camshaft rotational phase detecting apparatus for an engine provided with a variable valve timing control mechanism which controls a camshaft rotational phase of an engine valve to a target camshaft rotational phase by varying a rotational phase of a camshaft relative to a crankshaft, the camshaft rotational phase detecting apparatus being configured to:

detect a camshaft rotational phase as a detected camshaft rotational phase based on a signal from a sensor, wherein the detected camshaft rotational phase is substituted with a maintained rotational phase for a predetermined period and is substituted with a target camshaft rotational phase after a lapse of the predetermined period, when the camshaft rotational phase is not detected, wherein the maintained rotational phase is set corresponding to the detected camshaft rotational phase detected before a timing that the camshaft rotational phase is not detected, and wherein the predetermined period is set in accordance with an engine temperature.

2. A camshaft rotational phase detecting apparatus as claimed in claim 1, wherein the camshaft rotational phase is detected on a basis of outputs of a crank angle sensor and a cam angle sensor.

3. A camshaft rotational phase detecting apparatus as claimed in claim 1, wherein the detected camshaft rotational phase after the lapse of the predetermined period when the camshaft rotational phase is not detected is substituted with a most retarded camshaft rotational phase of the variable valve timing control mechanism as the target camshaft rotational phase.

4. A camshaft rotational phase detecting apparatus as claimed in claim 1, wherein the engine temperature is represented with at least one of an engine coolant temperature and an engine oil temperature.

5. A camshaft rotational phase detecting apparatus as claimed in claim 1, wherein the predetermined period is set smaller as the engine temperature becomes high.

6. A camshaft rotational phase detecting apparatus as claimed in claim 1, wherein the condition that the camshaft rotational phase is not detected is established when the engine is stopped.

7. A camshaft rotational phase detecting apparatus for an engine provided with a variable valve timing control mechanism which controls a camshaft rotational phase of an engine valve by varying a rotational phase of a camshaft relative to a crankshaft, the camshaft rotational phase detecting apparatus being configured to perform:

detecting a camshaft rotational phase as a detected camshaft rotational phase based on a signal from a sensor, wherein the detected camshaft rotational phase is substituted with a corrected rotational phase when the camshaft rotational phase is not detected, wherein the corrected rotational phase is provided by correcting the detected camshaft rotational phase detected before a timing that the camshaft rotational phase is not detected, with an engine temperature and an elapsed time from the timing becoming the condition that the camshaft rotational phase is not detected.

8. A camshaft rotational phase detecting apparatus as claimed in claim 7, wherein the corrected rotational phase is corrected to a retarded side of the variable valve timing control mechanism as the elapsed time becomes large.

9. A camshaft rotational phase detecting apparatus as claimed in claim 8, wherein the corrected rotational phase is corrected to the retarded side of the variable timing control mechanism with a higher degree as the engine temperature becomes high.

10. A camshaft rotational phase detecting apparatus as claimed in claim 7, wherein the camshaft rotational phase is detected on a basis of outputs of a crank angle sensor and a cam angle sensor.

11. A camshaft rotational phase detecting apparatus as claimed in claim 7, wherein the engine temperature is represented with at least one of an engine coolant temperature and an engine oil temperature.

12. A cylinder intake air quantity calculating apparatus for an engine, comprising:

a detecting section that detects a camshaft rotational phase as a detected camshaft rotational phase based on a signal from a sensor, wherein the detected camshaft rotational phase is substituted with a maintained rotational phase for a predetermined period and is substituted with a target camshaft rotational phase after a lapse of the predetermined period, when the camshaft rotational phase is not detected, wherein the maintained rotational phase is set corresponding to the detected camshaft rotational phase which is detected before a timing that the camshaft rotational phase is not detected; and a calculating section that calculates a mass air quantity sucked into a cylinder in accordance with the detected camshaft rotational phase derived from the detecting section.

13. A cylinder intake air quantity calculating apparatus as claimed in claim 12, wherein the calculating section calculates a closing timing of an intake valve in accordance with the camshaft rotational phase, calculates a volume of the cylinder from the closing timing of the intake valve, calculates a volume air quantity within the cylinder on the basis of the calculated volume of the cylinder and a fresh-air rate within the cylinder, calculates a mass air quantity sucked into the cylinder on the basis of a mass air quantity within an intake manifold of the engine calculated by income and outgo calculations of inflow and outflow quantities of a mass air within the intake manifold and a volume of the intake manifold.

14. A cylinder intake air quantity calculating apparatus for an engine, comprising:

a detecting section that detects a camshaft rotational phase as a detected camshaft rotational phase based on an output from a sensor, wherein the detected camshaft rotational phase is substituted with a corrected rotational phase when the camshaft rotational phase is not detected, wherein the corrected rotational phase is provided by correcting the detected camshaft rotational phase detected before a timing that the camshaft rotational phase is not detected, with an engine temperature and an elapsed time from the timing becoming the condition that the camshaft rotational phase is not detected; and a calculating section that calculates a mass air quantity sucked into a cylinder in accordance with the detected camshaft rotational phase derived from the detecting section.

15. A cylinder intake air quantity calculating apparatus as claimed in claim 14, wherein the calculating section calculates a closing timing of an intake valve in accordance with the camshaft rotational phase, calculates a volume of the cylinder from the closing timing of the intake valve, calculates a volume air quantity within the cylinder on the basis of the calculated volume of the cylinder and a fresh-air rate within the cylinder, calculates a mass air quantity sucked into the cylinder on the basis of a mass air quantity within an intake manifold of the engine calculated by income and outgo calculations of inflow and outflow quantities of a mass air within the intake manifold and a volume of the intake manifold.

16. A camshaft rotational phase detecting apparatus for an engine provided with a variable valve timing control mechanism which is hydraulically operated by hydraulic fluid and controls a camshaft rotational phase of a cam shaft by varying a rotational phase of a camshaft relative to a crankshaft, the camshaft rotational phase detecting apparatus being configured to:

detect a present camshaft rotational phase of the camshaft based on output of a sensor, wherein when an engine speed is below a predetermined level so that a hydraulic pressure for operating the variable valve control mechanism cannot be secured thereby enlarging a measuring error of the rotational phase of the camshaft relative to the crankshaft, the present detected camshaft rotational phase of the camshaft is substituted with a last detected camshaft rotational phase of the camshaft, thereby canceling the measuring error caused by a change in the camshaft rotational phase of the camshaft itself.

17. A cylinder intake air quantity calculating apparatus for an engine, comprising:

a detecting section that detects a camshaft rotational phase based on output of a sensor, wherein the camshaft rotational phase at this a time when an engine speed is below a predetermined level is substituted with the camshaft rotational phase which is detected at last time; and a calculating section that calculates a mass air quantity sucked into a cylinder in accordance with the detected camshaft rotational phase derived from the detecting section.

18. A cylinder intake air quantity calculating apparatus as claimed in claim 17, wherein the calculating section calculates a closing timing of an intake valve in accordance with the camshaft rotational phase, calculates a volume of the cylinder from the closing timing of the intake valve, calculates a volume air quantity within the cylinder on the basis of the calculated volume of the cylinder and a fresh-air rate within the cylinder, calculates a mass air quantity sucked into the cylinder on the basis of a mass air quantity within an intake manifold of the engine calculated by income and outputs calculations of inflow and outflow quantities of a mass of air within the intake manifold and a volume of the intake manifold.

* * * * *